US009891014B2

(12) United States Patent
Dechant

(10) Patent No.: US 9,891,014 B2
(45) Date of Patent: Feb. 13, 2018

(54) PISTOL

(71) Applicant: Glock Technology GmbH, Deutsch Wagram (AT)

(72) Inventor: Friedrich Dechant, Hollabrunn (AT)

(73) Assignee: Glock Technology GmbH (AT)

( * ) Notice: Subject to any disclaimer, the term of this patent is extended or adjusted under 35 U.S.C. 154(b) by 0 days.

(21) Appl. No.: 15/428,888

(22) Filed: Feb. 9, 2017

(65) Prior Publication Data

US 2017/0227313 A1 Aug. 10, 2017

(30) Foreign Application Priority Data

Feb. 10, 2016 (EP) ..... 16155097

(51) Int. Cl.
*F41A 21/48* (2006.01)
*F41A 11/00* (2006.01)
*F41C 3/00* (2006.01)

(52) U.S. Cl.
CPC ..... *F41A 11/00* (2013.01); *F41A 21/484* (2013.01); *F41C 3/00* (2013.01)

(58) Field of Classification Search
CPC ..... F41A 3/64; F41A 25/26; F41A 21/484; F41A 21/488
USPC ..... 42/7; 89/162, 170, 173, 176, 169, 180, 89/196
See application file for complete search history.

(56) References Cited

U.S. PATENT DOCUMENTS 2,107,359 A * 2/1938 Ernst ..... F41A 21/484 42/75.01
2,817,174 A * 12/1957 Liedke ..... F41A 11/00 42/7
3,745,881 A * 7/1973 Roy ..... F41A 3/64 89/138
4,539,889 A 9/1985 Glock
4,825,744 A 5/1989 Glock
4,893,546 A 1/1990 Glock
5,649,383 A * 7/1997 Wesp ..... F41A 21/484 42/44
7,823,314 B1 * 11/2010 Wheatley ..... F41A 21/484 42/75.02
8,807,010 B2 * 8/2014 Bubits ..... F41A 3/44 89/187.01
8,950,100 B2 * 2/2015 Nebeker ..... F41A 3/64 29/426.1

(Continued)

FOREIGN PATENT DOCUMENTS

DE 19507993 A1 9/1996

*Primary Examiner* — Reginald Tillman, Jr.
(74) *Attorney, Agent, or Firm* — Kolisch Hartwell, P.C.

(57) ABSTRACT

A pistol having a handle piece, a slide that is movable on the handle piece along guides, and a barrel. Provided in the handle piece is a blocking device for the forward movement of the barrel, where the blocking device has a retaining platelet that is movable in a slot and is under the action of a spring, for a barrel projection. A spring platelet is provided in the slot between the spring and the retaining platelet, where the spring platelet is designed such that it can be partially extracted from the slot transversely with respect to the center plane of the pistol. In this extracted position, the spring platelet is pivotable, together with the retaining platelet, against the force of the spring, with the result that the retaining platelet passes out of the movement path of the barrel projection and the slide can be withdrawn forward.

5 Claims, 8 Drawing Sheets

(56) References Cited

U.S. PATENT DOCUMENTS

| | | | | |
|---|---|---|---|---|
| 9,568,262 | B2 * | 2/2017 | Bantle | |
| 2017/0191784 | A1 * | 7/2017 | Kroyer | F41A 3/66 |

* cited by examiner

Figure 2A:
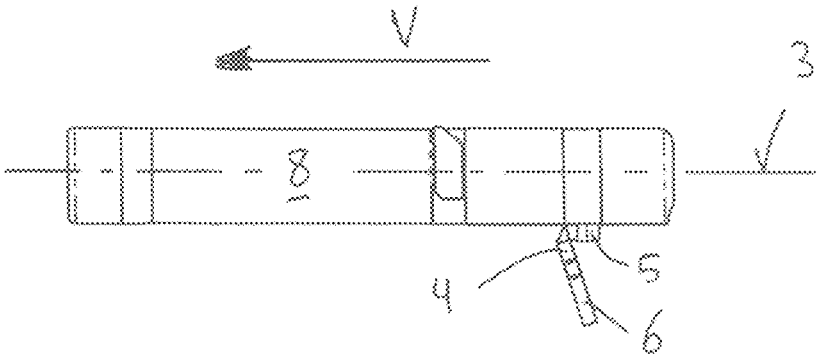
Figure 2B:
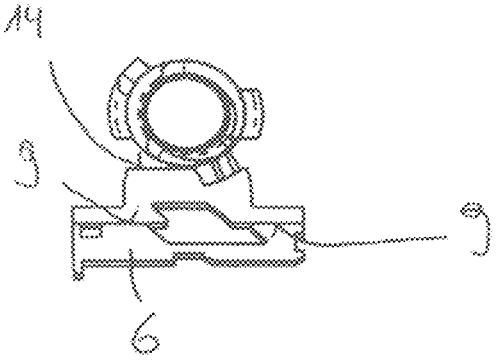

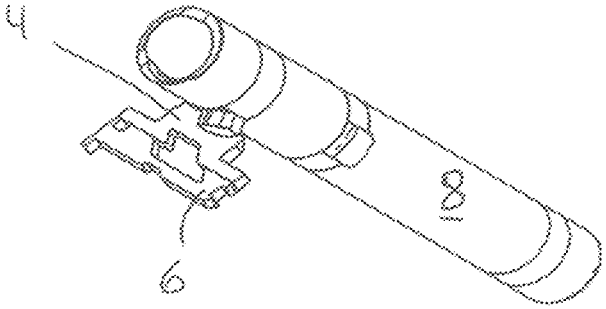
Fig. 2c
Fig. 2d
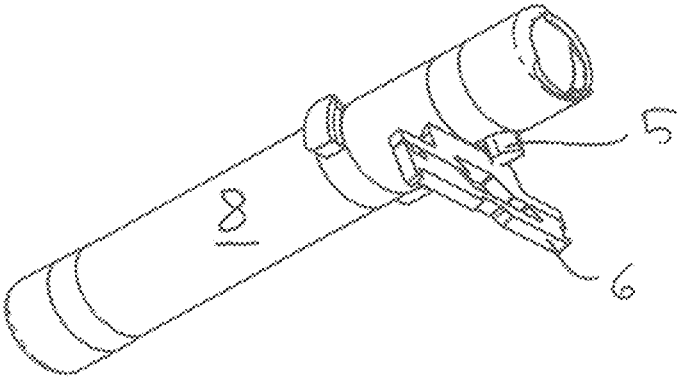

Fig. 3b
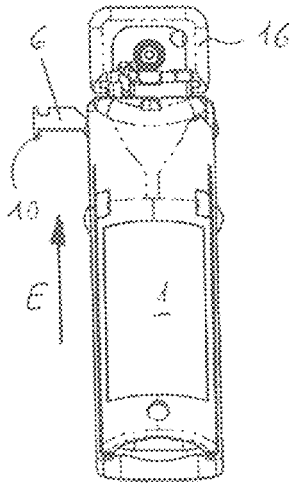
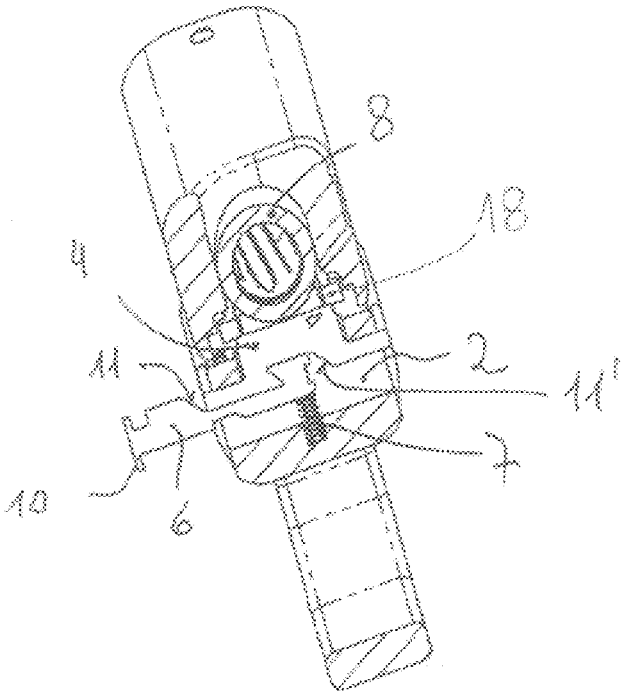
Fig. 3c

16
A

Figure 4A:
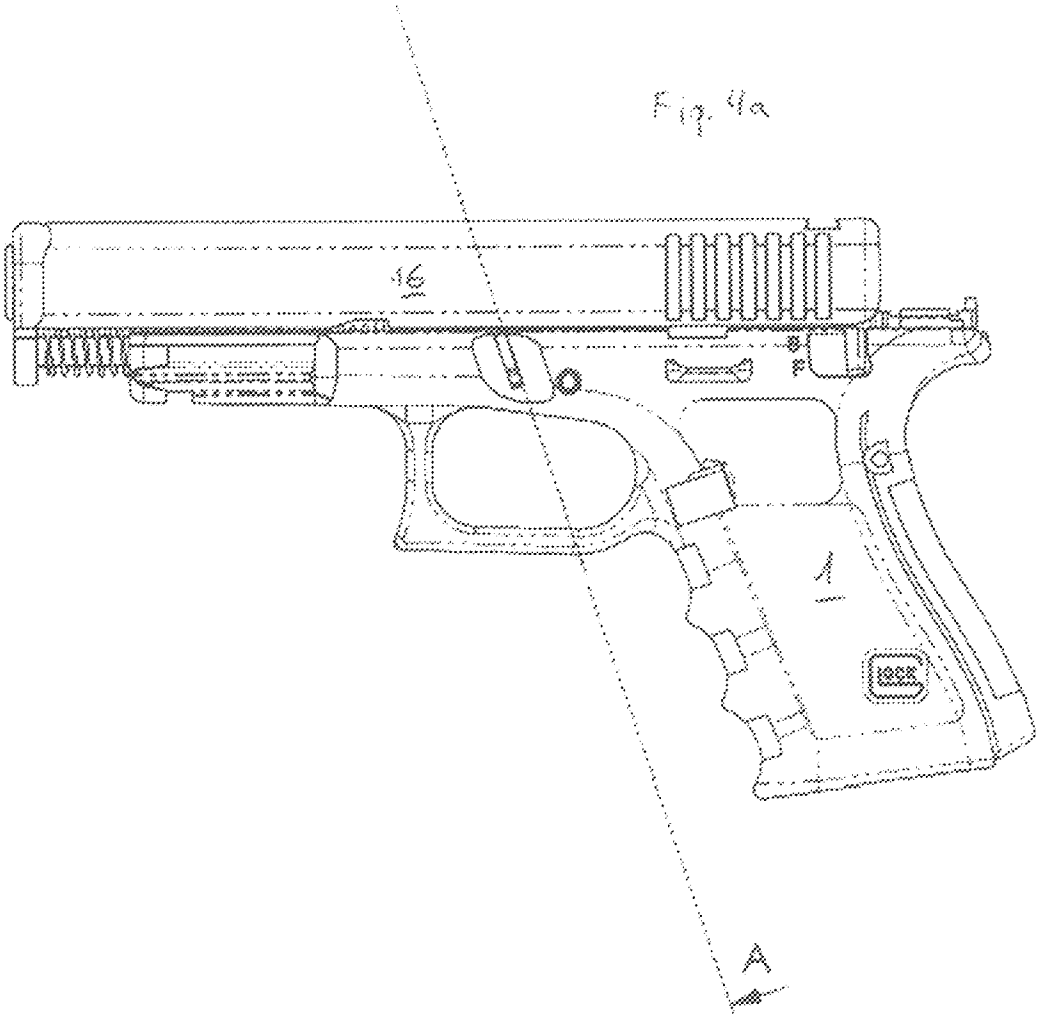

Fig. 4b
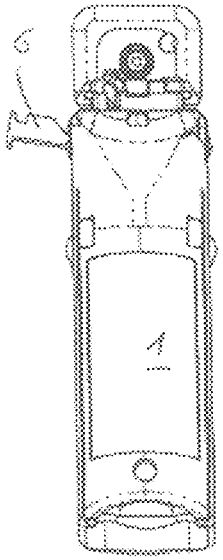
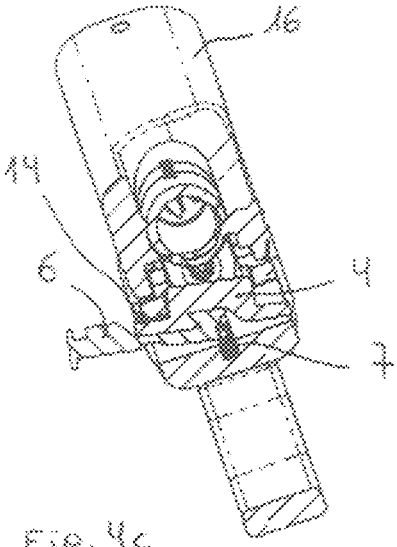
Fig. 4c

PISTOL

The invention relates to a pistol with a handle piece and a slide which is movable thereon, wherein the slide is limited in its movability by means of a blocking slider, in accordance with the preamble of Claim 1 and documents U.S. Pat. Nos. 4,539,889, 4,825,744 and 4,893,546. The content of these documents is incorporated by reference in the content of the present application for the jurisdictions in which this is possible.

These three documents disclose a drop-barrel pistol for which these documents describe two different mechanisms for fixing or releasing the drop barrel and thus the entire slide:

In a first variant, this mechanism comprises a web which extends normal to the barrel axis in the standby position of the barrel and which thus traverses the weapon from left to right and is arranged rotatably in the handle piece in an eccentric manner. In its uppermost position in which it can be appropriately fixed, said web projects into a groove provided obliquely on the barrel part, with the result that it determines the tilting movement of the barrel on the one hand and defines the foremost position thereof on the other hand. If this eccentrically mounted web is rotated into its lowermost position, it passes out of the movement range of the barrel and the latter, together with the slide, can be withdrawn forward and thus from the handle piece until the corresponding guides come out of engagement, with the result that the barrel and slide are finally separated from one another.

In the second variant, which has been used in practice millions of times, the tilting movement of the barrel is undertaken by a web mounted fixedly in the handle piece, said web being provided to lie below the barrel piece in the standby position of the drop barrel such that it does not impede a forward movement of the barrel. This task is performed by a blocking slider which is displaceable virtually normal to the barrel axis in the standby position of the barrel, but (if the mouth is directed to the left) in a manner rotated slightly from top left to bottom right, and is pressed upward by a leaf spring. In this upper limiting position which is defined by stops in the handle piece, the blocking slider projects into the movement path of a projection of the barrel piece and thus prevents any further movement of the barrel and thus of the slide in the forward direction. For safety reasons, this is reinforced by a hook-type connection between the barrel piece and blocking slider. The oblique position secures the exact positioning of the barrel since the latter is always pressed upward against a stop.

In order thus to disassemble the weapon, the user takes one hand to grip on both sides of the pistol the ends of the blocking slider which project barely beyond the outer contour and presses said blocking slider against the force of the leaf spring in the downward direction, and at the same time the slide is drawn back with the other hand against the force of the restoring spring, whereupon, by releasing the slide, the latter, together with the barrel, slides across the blocking slider and can be withdrawn forward.

This latter variant, owing to its symmetry and the resulting suitability for right-handed and left-handed users, is equally very popular and recognized but nevertheless has a slight disadvantage since, in order to release the slide, both hands have to be supported and moved in a coordinated manner against the force of springs in each case with respect to the handle piece, which demands not only a certain degree of dexterity and coordination but also an exertion of force by the fingertips which cannot always be assumed.

Another pistol, which is known from U.S. Pat. No. 2,817,174, has a barrel which is fixed with respect to the handle and which is fixed on a dovetail guide by means of a retaining pin movable perpendicularly thereto. The retaining pin is pulled into its fixing position by a blocking pin which, in turn, is under the action of a spring which also allows it to project partially from the handle piece. For disassembly, the blocking pin is displaced into the handle piece against the action of the spring and, by means of oblique run-on surfaces, the retaining pin can then be pushed out of its fixing position during removal of the barrel. This construction weakens the handle piece in the sensitive region between the barrel and breech; securing the individual components against loss and rotation is tricky; in the case of a dirty weapon, the movement of the retaining pin is ensured neither into its release position nor into its operating position; this construction originating from the 1950s has never gained acceptance on the market.

DE 195 07 993 discloses a construction similar to those mentioned at the outset, which causes a forward movement of the trigger by means of an add-on part and thus releases the trigger mechanism in the handle piece from the trigger mechanism in the slide. Owing to the complexity of the components, the inconveniently long lever arms and the tight tolerances to be maintained, this construction has not gained acceptance either.

It is therefore an aim and object of the invention to specify a blocking slider of the type stated at the outset which, in its operation, can be operated simply and without the coordinated application of force even by persons who have no training in the disassembly of the weapon.

These aims are achieved according to the invention by a blocking slider which has the features specified in the characterizing part of Claim 1; in other words, the one-part blocking slider in the prior art is replaced by two platelets which are arranged successively in the slot in the direction of the spring force; the spring platelet mounted closer to the spring here can be extracted laterally from the handle piece to a small extent in a captive manner, wherein the shape of the two platelets makes it possible for the platelet on the opposite side that is situated closer to the barrel to be pivoted downward, away from the barrel, against the force of the spring, with the result that it passes out of the movement path of a projection of the barrel and the latter, together with the slide, can be withdrawn forward.

Figure 1:
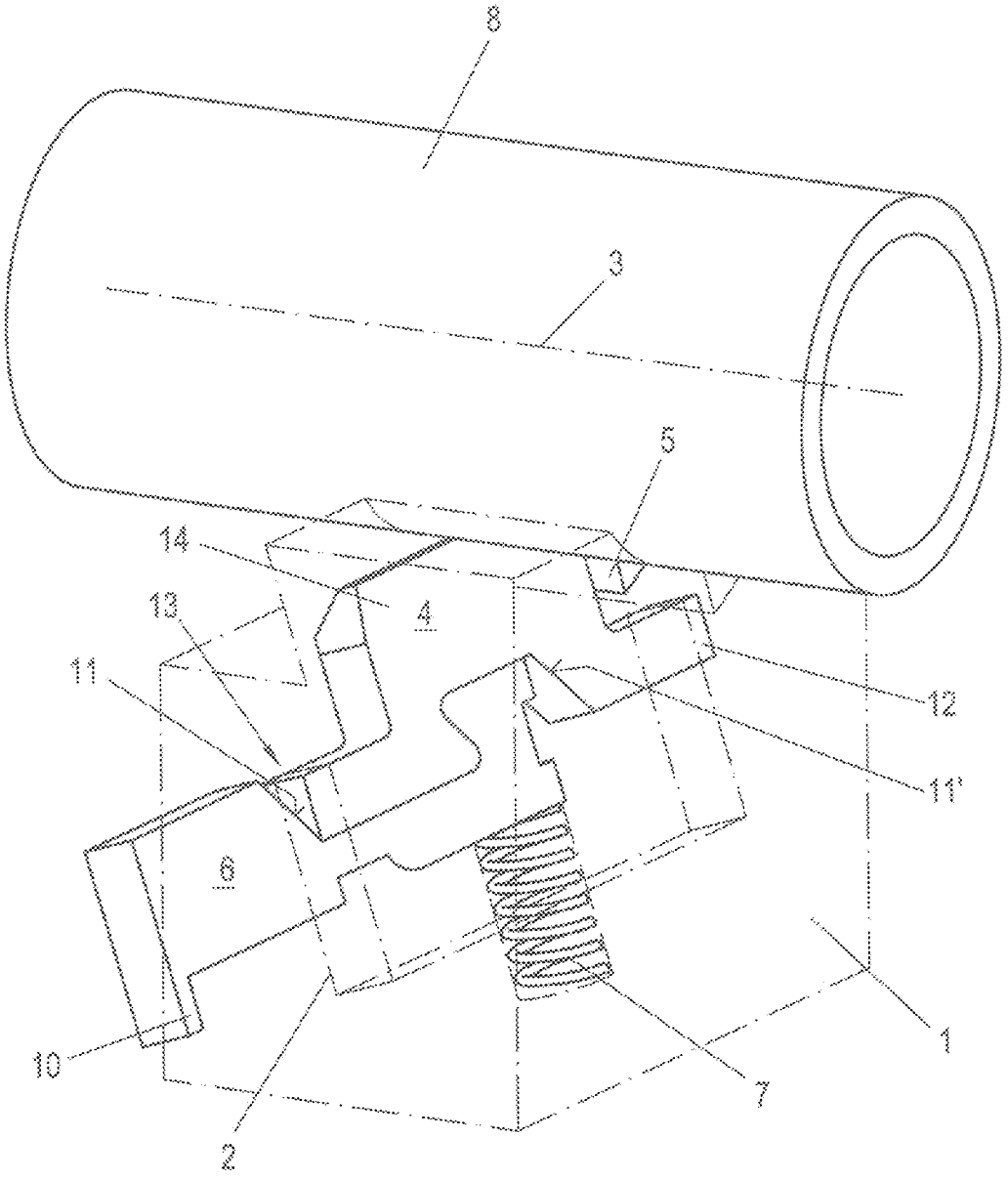
Figure 5:
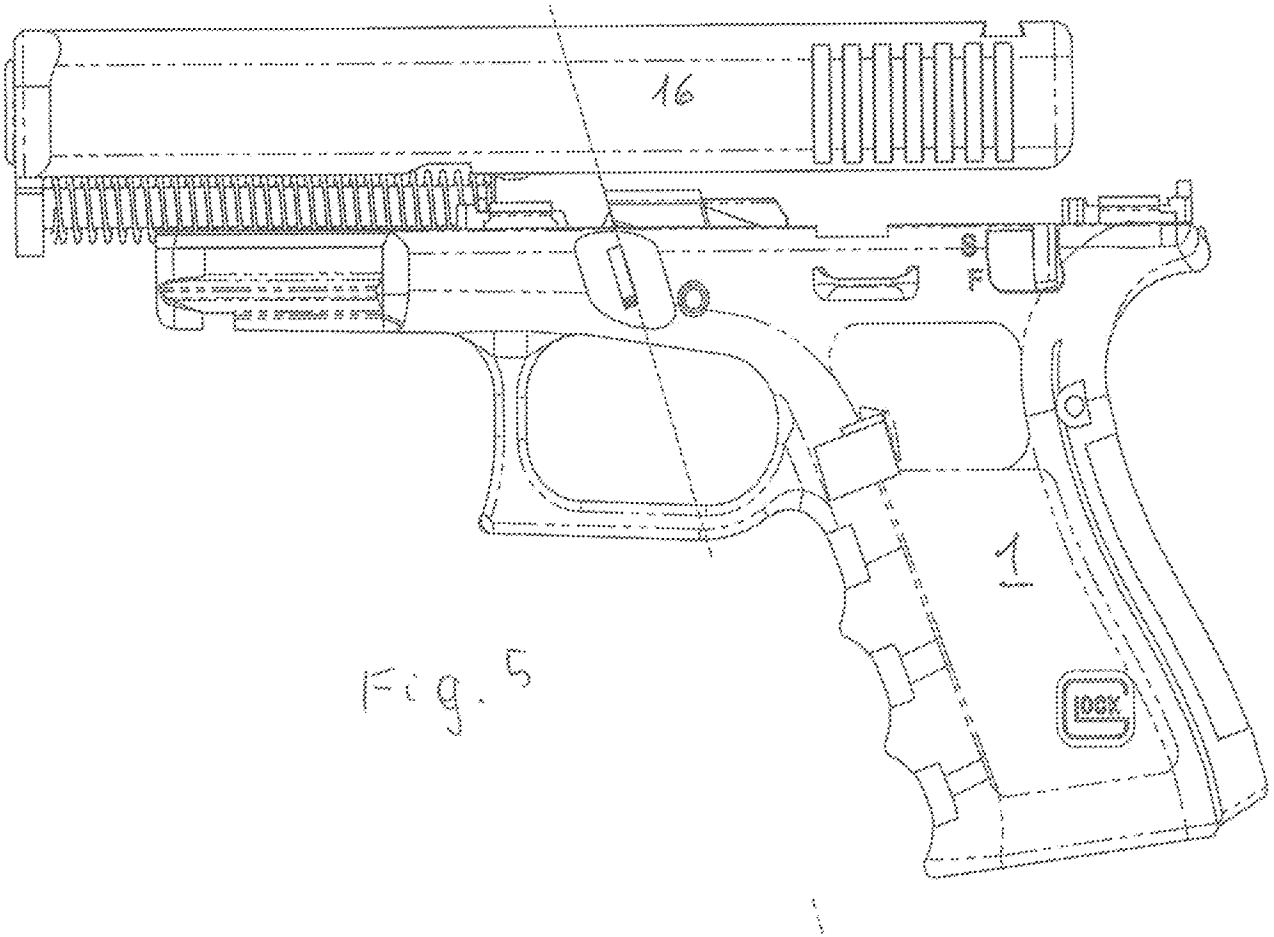

The invention is explained in more detail hereinbelow with reference to the drawing, in which FIG. 1 shows a perspective view of a blocking slider according to the invention in its application on a pistol with a rotating barrel, FIGS. 2*a* to 2*d* show the barrel and the retaining platelet in the blocking position in four different views in a pistol corresponding to FIG. 1, FIGS. 3*a* to 3*c* show a pistol formed according to the invention in a side view and rear view and along the section C-C of FIG. 3*a*, FIGS. 4*a* to 4*c* show corresponding views of the various positions of the individual parts during disassembly or assembly, and FIG. 5 shows the removal of the slide from the handle piece.

In the description and the claims, the terms "front", "forward", "rear", "rearward", "top", "upward", "bottom", "downward" and so on are used in the common form and with reference to a pistol which is held in the customary manner. This means that the mouth of the barrel is at the "front", that the breech or slide is moved "rearward" by the explosion gases, etc.

FIG. 1 shows a perspective view of a blocking slider according to the invention in a purely schematic manner and limited exclusively to the region of the blocking slider with a schematically indicated barrel, without going into the details of the pistol itself. Provided in a handle piece 1 is a slot 2 which extends obliquely to the barrel axis 3 and transversely through the weapon. In the case of pistols with a drop barrel, the barrel axis 3 represented as reference is the axis which the barrel has with respect to the handle piece if it is in its rest position before the firing of a shot. A blocking slider consisting of two platelets is accommodated in the slot 2 which, with respect to the plane normal to the barrel axis 3, is slightly inclined from top front to bottom rear (in FIG. 1, the mouth of the barrel is on the left-hand side, with the breech, the firing mechanism and the handle being considered to be on the right-hand side). Said blocking slider has an upper retaining platelet 4, which, depending on its position along the axis of a helical spring 7, interacts with a projection 5 of the barrel or not, and a lower platelet, a spring platelet 6, onto which the helical spring 7 presses obliquely from the bottom in the direction of the slot 2 so as to press said spring platelet upward in the direction of the barrel 8.

In the mounted state, and when viewed for instance in the direction of the barrel axis 3, the retaining platelet 4 has the shape of an "A" in rough outline. Its central part is designed here such that it is guided with slight play in the direction transverse to the weapon by the flanks of the handle piece 1 or strip-like projections provided specially therefor or a plurality of punctiform projections provided specially therefor. The spring platelet 6 substantially has the shape of a "U".

FIG. 1 shows the situation in which the spring platelet 6 has been partially extracted from the slot 2 into the release position from its customary locking position with the aid of a projection 10, which serves as a grip, transversely to the center plane of the pistol. For this purpose, the spring platelet 6 is dimensioned such that, even in the blocking position, the projection 10 has a small spacing from the outer wall of the handle piece 1 at this point in order that it can be rearwardly engaged by means of a finger or fingernail and extracted.

It should be noted that, owing to the U shape of the spring platelet 6 with an oblique groove wall 11 on its extraction side, an upward movement within the groove in the direction of the axis of the spring 7 toward the barrel occurs during the extraction, wherein at the same time the extraction-remote end of the spring platelet 6 on an oblique groove surface 11' on the underside of the retaining platelet 4, and, during this extraction, the spring platelet 6 carries out no, or at least no noticeable, rotary movement, but is displaced then only at first transversely to the axis of the spring 7. This is achieved by the parallel formation of the groove wall 11 with the groove surface 11'. Furthermore, the hook-shaped formation of the mutually facing surfaces of the two platelets causes a limitation of the extraction movement of the spring platelet 6, and the retaining platelet 4 is guided and secured by a narrowing above the slot and an analogous narrowing of the retaining platelet 4.

Furthermore, it is of importance that the extraction-remote part of the spring platelet 6 is of undercut design and comes into flat contact with an oppositely undercut groove surface of the retaining platelet 4, with the result that, in the position shown in FIG. 1, the two platelets are positively connected to one another, and a separation is possible only in the direction of the two oblique groove surfaces 11. If the position represented has been reached, it is easily possible for the user to press the remote end 12 of the retaining platelet downwardly against the force of the spring 7 and, owing to the geometric conditions (the narrowing of the slot is tailored thereto), it occurs that the retaining platelet 4 is rotated with the spring platelet 6 like a single platelet in the clockwise direction about the support of the retaining platelet 4 on the upper surface of the slot 2, which is possible as a result of the design of the outer flanks of the retaining platelet 4 and the corresponding mating surfaces in the interior of the handle piece 1. This rotation causes the uppermost region, the retaining region 14, of the retaining platelet to pass out of the movement path of the barrel projection 5 and the barrel, together with the slide, can be withdrawn forward.

As known from the prior art, it is possible through the corresponding formation of bevels on the front side of the retaining platelet 4 and the rear side of the barrel projection 5 (mouth at the front) to dispense with a corresponding manual release during assembly as long as only the spring platelet 6 is in the release position represented.

FIGS. 2*a* to 2*d* show the situation only with the barrel 8 and the two platelets 4 and 6 in the retaining position: the two platelets rest on one another by way of their mutually facing latching surfaces (designated equally by 9) each provided at the end of the legs of the "A" and of the "U". The "U" shape and the "A" shape give rise to an opening in the central region and the retaining region 14 assumes the uppermost position which is closest to (or contacts) the barrel 8. A comparison with the release position of FIG. 1 shows the considerably greater height of the two plates as a whole in this retaining position. Here, the barrel projection 5 bears on the retaining region 14 such that it cannot move forward past it in the direction of the axis 3 in the direction of the arrow V; the barrel 8, and thus the slide 16, is fixed (movably) on the handle piece.

Figure 3A:
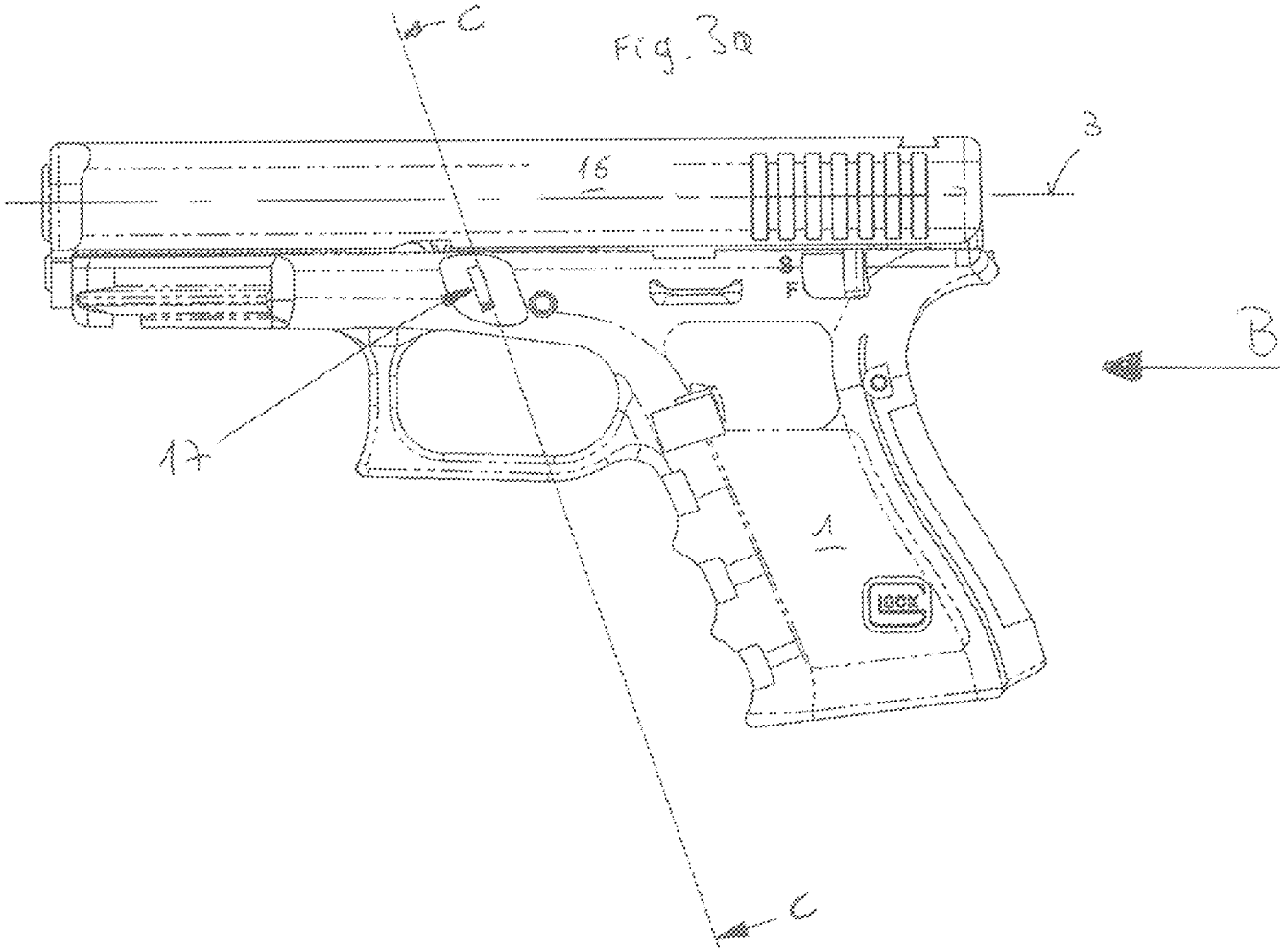

FIG. 3*a* shows a side view of a pistol 15 with a handle piece 1 and a slide 16 and also the retaining device 17 explained with reference to FIGS. 1 and 2. The barrel mouth (at the front) is on the left in the illustration, with the carriage 16 above the handle piece 1.

FIG. 3*b* shows the view in the direction of the arrow B; the spring platelet 6 is extracted laterally from the handle piece out of its rest position—operating position—; its projection 10, which facilitates this extraction, can be seen clearly, as can the extraction-side shoulder of the oblique groove wall 11.

FIG. 3*c* shows the section C-C of FIG. 3*a*, likewise with extracted spring platelet 6. The spring 7, by which it is urged toward the barrel 8, can be seen clearly, as can the retaining platelet 4. The slot 2, which contains the platelets and partially also the spring, has a dimension away from the barrel 8 that allows the removal of the slide 16 explained hereinbelow.

If, in the position between slide and handle piece illustrated in FIG. 3, the spring platelet is, as illustrated in FIG. 4, pivoted in the clockwise direction by a force being exerted, for unlocking, in the direction of the arrow E on the part of the spring platelet 6 projecting from the handle piece, the spring platelet 6 and retaining platelet 4 are rotated together against the force of the spring 7 about the outer edge of the handle piece in the region of the support 13 (FIG. 1), with the result that the retaining region 14 passes out of the movement path, which extends parallel to the axis 3, of the barrel projection 5; the barrel and slide can be moved forward along the guides 18 between them and the handle piece until the position in FIG. 4 has been reached.

FIG. 4 shows, in the same illustrations as FIG. 3, the situation directly before lifting off the slide in the upward direction. Only the most important reference signs have been entered; what should be noted is the rotation of the spring platelet 6 together with the retaining platelet 4 as a result of the engagement of the undercuts or hooks of the two platelets. Consequently, the overall height thereof is also reduced and allows pivoting about the outer edge of the retaining region 14. In the position of the slide with respect to the handle piece that is shown in FIG. 4, the guides 18 between these two parts have come out of engagement, and, as shown in FIG. 5, the slide 16 can be lifted off from the handle piece 1.

The invention is not restricted to the example which has been represented and described, but can be modified in a variety of ways. Thus, particularly an adaptation to the drop barrels mentioned at the outset is no problem for a person skilled in the art with knowledge of the invention; the axis 3 then corresponds to the position of the barrel axis in the ready-for-firing state. The reasons for the oblique position of the slot 2 have been dealt with at the outset, it of course being possible to choose another orientation or to provide the slot in a plane normal to the axis 3.

The shape of the platelets can vary, it only being essential that pivoting of the two platelets is ensured in the extracted position of the spring platelet. The fact that, as in the example illustrated, positive securement is achieved in addition to the spring 7 in the use mode, because the overall constructional height of the two platelets in the direction of action of the spring 7 is large enough for the barrel projection 5 to be securely held, is a bonus but not a necessity.

The material employed can be all the materials also used hitherto in the prior art, with the production and processing also presenting no problem with knowledge of the invention.

| List of reference signs: | |
|---|---|
| 01 | Handle piece |
| 02 | Slot |
| 03 | Axis |
| 04 | Retaining platelet |
| 05 | Barrel projection |
| 06 | Spring platelet |
| 07 | Spring |
| 08 | Barrel |
| 09 | Latching surface(s) |
| 10 | Projection |
| 11 | Oblique groove wall |
| 11' | Oblique groove surface |
| 12 | Extraction-remote end |
| 13 | Support |
| 14 | Retaining region |
| V | Arrow in the forward direction |
| 15 | Pistol |

-continued

| List of reference signs: | |
|---|---|
| 16 | Slide |
| 17 | Retaining device |
| 18 | Guide(s) |
| E | Arrow in unlocking direction |

What is claimed:

1. A pistol, comprising:

a handle piece having guides thereon;

a slide that is movable on the handle piece along the guides;

a barrel having a barrel projection; and a blocking device provided in the handle piece that is configured so that when the blocking device is in a retaining position, the blocking device blocks the forward movement of the barrel, wherein the blocking device includes:

a retaining platelet that is movably disposed in a slot in the handle piece;

a spring configured to apply a force to the retaining platelet so that the retaining platelet is disposed in a movement path of the barrel projection; and a spring platelet that is disposed in the slot between the spring and the retaining platelet and configured so that the spring platelet can be partially extracted from the slot transversely with respect to a center plane of the pistol, and when the spring platelet is partially extracted it can be pivoted with the retaining platelet against the force of the spring, so that the retaining platelet is removed from the movement path of the barrel projection.

2. The pistol of claim 1, wherein the retaining platelet is substantially "A"-shaped and the spring platelet is substantially "U"-shaped, so that when the blocking device is disposed in the retaining position, the legs of the retaining platelet and the legs of the spring platelet are opposed to one another, and contact one another at latching surfaces disposed at the ends of their respective legs.

3. The pistol of claim 2, wherein when the blocking device is disposed in a release position, a leg of the "U"-shape of the spring platelet nests in a concavity defined by the "A"-shape of the retaining platelet, and a leg of the "A"-shape of the retaining platelet nests in a concavity defined by the "U"-shape of the spring platelet.

4. The pistol of claim 2, wherein when disposed in the retaining position, an overall height of the retaining platelet and the spring platelet in combination is greater than a depth of the slot.

5. The pistol of claim 1, wherein the spring platelet defines an undercut or hook shape, and the retaining platelet defines a complementary undercut or hook shape, such that an interaction between the two undercut or hook shapes limits an extent to which the spring platelet can be extracted.

* * * * *